United States Patent [19]

Weitman

[11] Patent Number: 4,614,938

[45] Date of Patent: Sep. 30, 1986

[54] DUAL CHANNEL PYROELECTRIC INTRUSION DETECTOR

[75] Inventor: Irwin Weitman, East Northport, N.Y.

[73] Assignee: Pittway Corporation, Syosset, N.Y.

[21] Appl. No.: 612,594

[22] Filed: May 21, 1984

[51] Int. Cl.[4] ..... G08B 13/18

[52] U.S. Cl. ..... 340/567; 250/340; 250/370; 250/371

[58] Field of Search ..... 340/567, 555; 250/371, 250/370 R, 340

[56] References Cited

U.S. PATENT DOCUMENTS

| | | | |
|---|---|---|---|
| 3,842,276 | 10/1974 | Southgate | 250/336 |
| 3,928,843 | 12/1975 | Sprout et al. | 340/567 |
| 4,166,955 | 9/1979 | Keller | 250/342 |
| 4,225,786 | 9/1980 | Perlman | 250/342 |
| 4,258,259 | 3/1981 | Obara et al. | 250/370 |
| 4,296,324 | 10/1981 | Kern et al. | 250/340 |
| 4,364,030 | 12/1982 | Rossin | 340/567 |
| 4,384,207 | 5/1984 | Doctor | 250/349 |

*Primary Examiner*—Glen R. Swann, III

[57] ABSTRACT

An intrusion detection system includes a plurality of infrared radiation sensitive elements, each of which comprises first and second spaced electrodes between which polarized pyroelectric material is positioned, each element being operative to produce a voltage proportional to the rate of change of infrared radiation incident thereon. The elements are closely spaced to one another and cover substantially all of at least one surface of the pyroelectric material. Multiple fields of view of areas under surveillance are fully covered (with negligibly small gaps). Alternate sensor elements are connected to a first amplifier channel and the other sensor elements are connected to a second amplifier channel. Coincidence means produces an alarm output in response to concurrent intruder signal generation by both of the amplifier channels.

20 Claims, 7 Drawing Figures

DUAL CHANNEL PYROELECTRIC INTRUSION DETECTOR

BACKGROUND OF THE INVENTION

This invention relates to intrusion detection systems, and more particularly to systems for detecting the presence of an intruder within the boundaries of an area under surveillance.

Numerous systems have been designed and are presently in use which use pyroelectric or other heat sensitive materials as intruder sensing elements. Pyroelelectric materials include plastic film materials such as polyvinylidene fluoride, crystal materials such as lithium tantalate, and ceramic materials such as lead zirconate titanate. Such devices typically are poled, i.e., polarized, and have electrodes on their polarized areas such that, when radiant infrared energy falls upon the material, a small voltage appears between the electrodes due to internal transfer of electric charge that is amplified to signal an intrusion. Each sensor element is adapted to view one or more different areas in the space under surveillance (by means of focusing lenses or mirrors, for example). When an intruder enters one of the fields of view, the intruder's body heat causes a momentary change in the temperature of that sensor element which causes an output voltage to be produced across its load impedance. This voltage is amplified and an alarm signal is generated in response thereto.

Because these pyroelectric materials are extremely sensitive to temperature (and usually to pressure), the devices respond to environmental changes in pressure and temperature. In an effort to reduce alarms generated by such environmental changes, sensitive areas (elements) have been connected in electrical series or parallel opposition for common mode rejection. In response to an environmental change, both elements are excited equally and because they are connected in electrical opposition, the output is cancelled and no alarm is generated. Such systems also tend to produce occasional output voltage artifacts in the form of "bursts" and/or spikes (due to defects in the elements or in the amplifiers) which cause false alarms.

SUMMARY OF THE INVENTION

In accordance with the invention there is provided an intrusion detection system that includes a plurality of infrared radiation sensitive elements, each element comprising first and second spaced electrodes between which pyroelectric material is positioned, and each element being operative to produce a voltage proportional to the rate of change of infrared radiation incident thereon. The elements are closely spaced to one another (the spacing being less than the width of the elements) so that the regions under surveillance are fully covered (with negligibly small gaps). The pyroelectric material of each element is polarized so that one group of the elements are polarized in one direction and another similar group is polarized in the other direction. First and second amplifier channels are connected to the detector elements and coincidence means produces an alarm output in response to concurrent intruder signal generation by both of the amplifier channels.

In preferred embodiments, the pyroelectric material has parallel opposed surfaces on which the electrode areas are located, the spacing between the edges of the spaced electrodes is less than ten percent of the width of the spaced electrodes, the edges of the electrodes are parallel to one another and spaced apart less than 0.1 millimeter, and the electrodes cover substantially all of one of the opposed surfaces. Focusing means, for example a mirror or lens, is preferably included for focusing infrared radiation from multiple fields of view on corresponding ones of the infrared radiation sensitive elements. In one particular embodiment the elements are similarly polarized and alternate elements are connected in series opposition to the first and second amplifier channels, while in other particular embodiments the elements are polarized in pairs and alternate elements are connected in parallel to the first and second amplifier channels. In preferred embodiments the pyroelectric material is selected from the class consisting of lithium tantalate, lead zirconate titanate, lead germanate, strontium barium niobate, and polyvinylidene fluoride. In a particular embodiment, each amplifier channel includes a field effect transistor, an absolute value detector circuit and a pulse stretcher circuit; and the coincidence circuit means includes logical AND circuitry.

The invention provides intrusion detection systems that more effectively utilize available area of pyroelectric materials and reduce the incidence of false alarms.

BRIEF DESCRIPTION OF THE DRAWING

Other features and advantages will be seen as the following description of particular embodiments progresses, in conjunction with the drawings, in which.

DESCRIPTION OF PARTICULAR EMBODIMENTS

Figure 1:
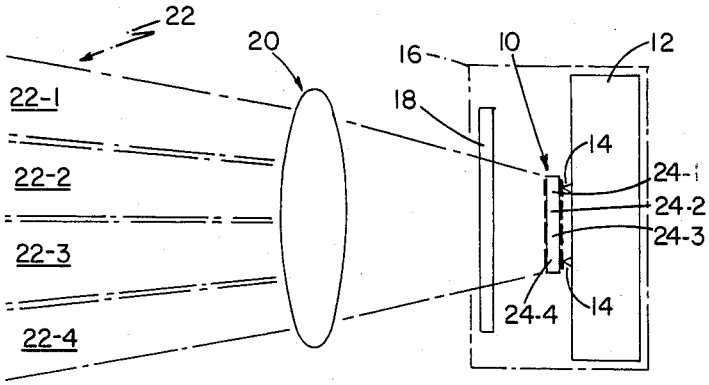
FIG. 1 is a diagrammatic view of a differential pyroelectric intrusion detection system in accordance with the invention.

With reference to FIG. 1, pyroelectric detector 10 is supported on base 12 by support elements 14 and is mounted within enclosure 16 that has an opening across which is an optical filter 18 (narrow bandpass to infrared radiation). A lens or other appropriate focusing element 20 focuses infrared radiation from fields of view 22-1 - 22-4 on corresponding sensor areas 24 of detector 10.

Figure 2:
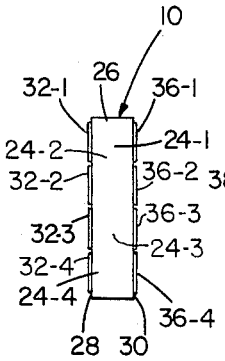
FIG. 2 is a side view of the pyroelectric detector array employed in the system of FIG. 1.
Figure 3:
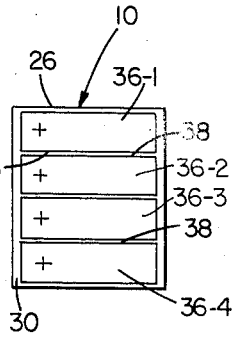
FIG. 3 is a rear view of the pyroelectric detector of FIG. 2.

With reference to FIGS. 2 and 3, the differential pyroelectric detector 10 comprises a wafer element 26 of pyroelectric material that is a relatively thin rectangular solid body. Element 26 has a first surface 28 directed towards incident radiation and a rear surface 30 that is substantially parallel and oppositely directed to surface 28. While element 26 is of lithium tantalate, a crystalline material commonly employed in pyroelectric detectors, other appropriate materials may be used, for example, lead zirconate titanate, lead germanate, or strontium barium niobate. By way of example, the illustrated wafer has a length of about three millimeters, a width of two and one-half millimeters, and a thickness of about fifty microns.

A series of four relatively thin electrically conductive electrode areas 32-1, 32-2, 32-3, 32-4 is deposited on surface 28 by vapor deposition, areas 32 may comprise a layer of chrome of about fifty angstroms thickness and a layer 36 of nichrome of about one-hundred fifty angstroms thickness. Four similar electrode areas 36-1, 36-2, 36-3 and 36-4, are formed on the rear surface 30 of wafer 26, each being similarly include a layer of chrome, a layer of nichrome and optionally gold deposited on the nichrome. Alternately, each of the electrode areas 32, 36, for example, may be entirely of nichrome or entirely of aluminum. In the illustrated device, each of the areas 32, 36 has a length of about 1.6 millimeters, a width of about 0.5 millimeter and a maximum thickness of about one thousand angstroms. The spacing between adjacent edges 38 of areas 32, 36 is less than 0.1 millimeter, the spacing of those areas principally being dependent on the limitations imposed by the manufacturing process, but being sufficiently close so that the elements 24-1 - 24-4 maximize the use of the available optical area without electrical or optical overlap or contact.

Wafer 26 is mounted on base 12 by mounting members 14. Detector 10 comprises four heat sensitive capacitors or charge generators 24-1 - 24-4 that are defined in the body of pyroelectric material 26 in the regions between electrode areas 32 and corresponding areas 36. The pyroelectric material is polarized as shown by the polarity indications in FIG. 3.

Figure 4:
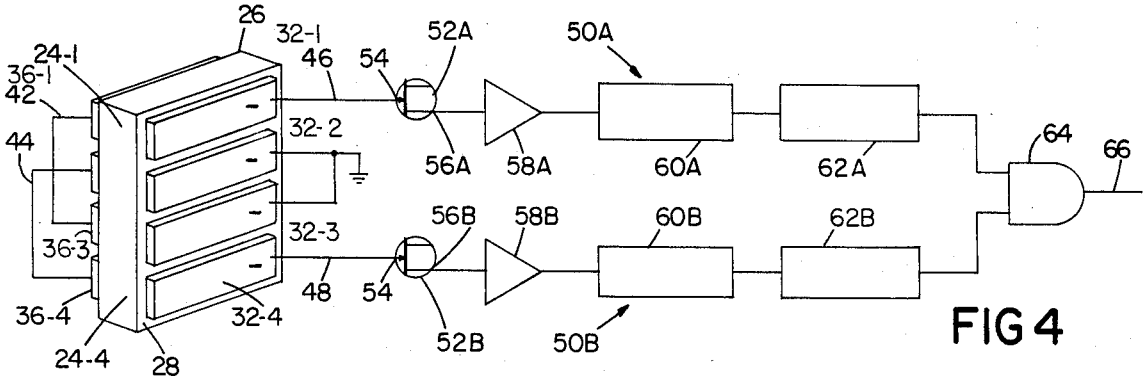
FIG. 4 is a schematic diagram of circuitry connected to the sensor array of FIG. 1.

With reference to FIG. 4, the positive pole of charge generator 24-1 is connected to the positive pole of charge generator 24-3 by connection 42; the positive pole of charge generator 24-2 is connected to the positive pole of charge generator 24-4 by connection 44; the negative pole of charge generator 24-2 and the negative pole of charge generator 24-3 are connected to ground; the negative pole of charge generator 24-1 is connected to amplifier channel 50A by connection 46; and the negative pole of charge generator 24-4 is connected to amplifier channel 50B by connection 48. Each amplifier channel includes a field effect transistor 52 that has a gate terminal 54, that is connected to a charge generator 24, a drain terminal and a source terminal 56 that is connected to a band pass amplifier 58. Connected to amplifier circuitry 58 is absolute value detector circuitry 60 and pulse stretcher circuitry 62. The outputs of the two pulse stretcher circuits 62 are applied as inputs to logical AND circuit 64.

Figure 5:
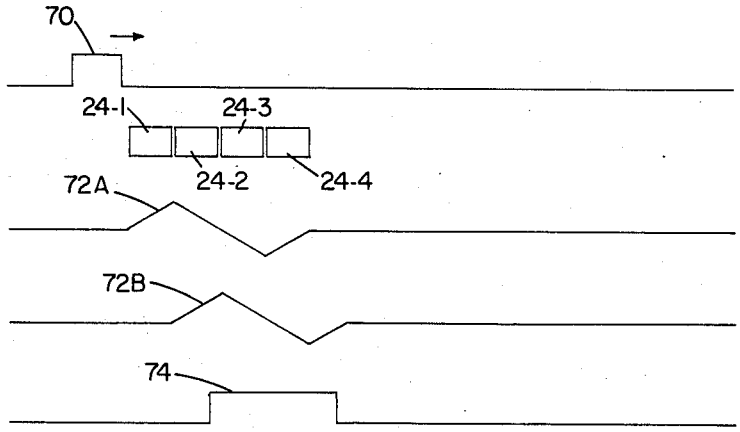
FIG. 5 is a timing diagram illustrating operation of the system of FIG. 1.

With reference to FIG. 5, when an intruder's image 70 illuminates any two adjacent sensors 24, each of the two channels 50 amplifies the resulting pulse 72 (the time constants of the pulse stretcher circuitry 62 being sufficient to allow for slow moving targets at maximum range). Logical coincidence of signals 72 from both channels produces an alarm signal 74 at system output terminal 66. Should a noise impulse occur in only one channel 50, no alarm signal is produced at the system output. Amplifier gain can be increased to obtain greater system sensitivity without increase in the false alarm rate.

Figure 6:
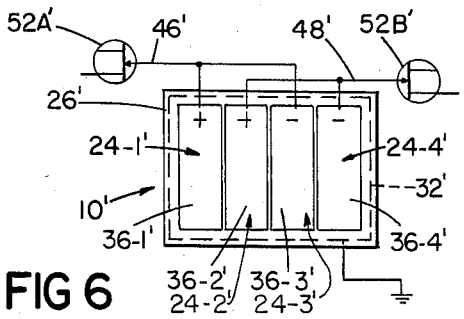
FIG. 6 is another array of pyroelectric detectors in accordance with the invention.

The detector array shown in FIG. 6 is similar to the detector array of FIGS. 2 and 3 with four electrode areas 36-1' - 36-4', a common electrode 3' on the opposite surface, elements 24-1' and 24-2' being similarly polarized and elements 24-3' and 24-4' being oppositely polarized. Elements 24-1' and 24-3' are connected in parallel to amplifier channel 50A' by connection 46' while sensor elements 24-2' and 24-4' are also connected in parallel to amplifier channel 50B by connection 48'. The spacings of the electrode areas 36' are again close (as in the FIG. 1-3 embodiment)—less than 0.1 millimeter—and similarly, logical coincidence of signals from both channels produces an alarm signal at the system output terminal.

Figure 7:
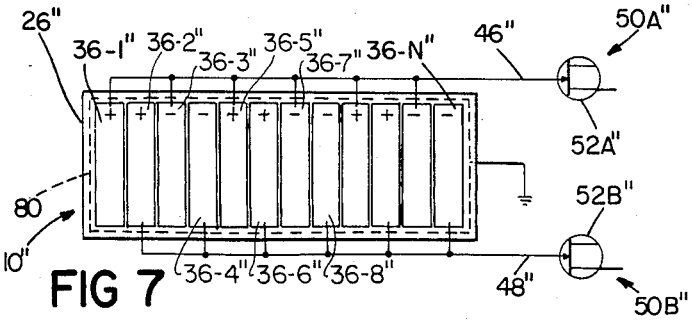
FIG. 7 is a diagram of still another pyroelectric detector array in accordance with the invention.

Still another embodiment is shown in FIG. 7. That infrared radiation sensor detector array 10'' comprises a film 26'' (six - twelve microns thick) of polyvinylidene fluoride. On one surface of film 26'', a single elongated electrode 80 is formed, such as by a conventional evaporated metallisation process, that extends over the entire length of film 26'' in the central region thereof. On the opposite surface of film 26'', a plurality of electrodes 36-1'' - 36-N'' are similarly formed. The spacings of the edges of the electrode areas 36'' are close (as in the FIGS. 1-3 and FIG. 6 embodiments). Each electrode 36'' extends in a direction transverse to electrode 80, preferably perpendicular thereto, and thus forms a linear array of heat sensitive capacitors. In order to be pyroelectric it is necessary that substrate 26'' be "poled", that is treated so that its molecules are aligned to provide a permanent electric field within the film. To pole film 26'', the film is subjected to an electric field of approximately one thousand volts per mil of thickness at a temperature of approximately 100° C. for thirty minutes and then cooled while the voltage remains applied. The oppositely poled sensors 24 may be formed by connecting electrode areas 36-1'', 36-2'', 36-5'', 36-6'', etc. to a positive poling voltage, and electrode areas 36-3'', 36-4'', 36-7'', 36-8'', etc. to a negative poling voltage so that oppositely poled pairs of heat sensitive capacitor are produced in plastic film strip 26'' as indicated in FIG. 7. After polarization, the electrode areas are reconnected as indicated in FIG. 7 to leads 46'', 48''. Similarly to the other embodiments, logical coincidence of intruder generated signals from both channels produces an alarm signal at the system output terminal.

While particular embodiments of the invention have been described, various modifications will be apparent to those skilled in the art, and therefore it is not intended that the invention be limited to the disclosed embodiments or to details thereof, and departures may be made therefrom within the spirit and scope of the invention.

What is claimed is:

1. An intrusion detection system comprising a member of pyroelectric material, a plurality of infrared radiation sensitive elements, each said element comprising first and second spaced electrodes between which a portion of said member of pyroelectric material is positioned, each said element being operative to produce a voltage proportional to the rate of change of infrared radiation incident thereon, said elements being closely spaced to one another (the spacing being less than the width of the elements) so that the regions under surveillance are essentially fully covered, the pyroelectric material portion of each element being polariazed, first and second amplifier channels, means connecting one group of said polarized elements to said first amplifier channel, means connecting another similar group of said polarized elements to said second amplifier channel, and coincidence means for producing an alarm output in response to concurrent intruder signal generation by both of said channels.

2. The system of claim 1 wherein the spacing between the edges of said spaced electrodes is less than ten percent of the width of said spaced electrodes.

3. The system of claim 1 wherein the edges of said spaced electrodes are parallel to one another and spaced apart less than 0.1 millimeter.

4. The system of claim 1 wherein said member of pyroelectric material is polarized uniformly in one direction.

5. An intrusion detection system comprising a plurality of infrared radiation sensitive elements, each said element comprising first and second spaced electrodes between which pyroelectric material is positioned, each said element being operative to produce a voltage proportional to the rate of change of infrared radiation incident thereon, said elements being closely spaced to one another (the spacing being less than the width of the elements) so that the regions under surveillance are essentially fully covered, the pyroelectric material of each element being polarized, said elements being polarized in pairs, first and second amplifier channels, means connecting one group of alternate ones of said polarized elements in parallel to said first amplifier channel, means connecting another similar group of alternate ones of said polarized elements in parallel to said second amplifier channel, and coincidence means for producing an alarm output in response to concurrent intruder signal generation by both of said channels.

6. The system of claim 1 wherein said pyroelectric material is selected from the class of lithium tantalate, lead zirconate titanate, lead germanate, strontium barium niobate, and polyvinylidene fluoride.

7. The system of claim 1 wherein said pyroelectric material is a film of polyvinylidene fluoride.

8. The system of claim 1 wherein each said amplifier channel includes a field effect transistor, an absolute value detector circuit and a pulse stretcher circuit.

9. The system of claim 1 wherein said coincidence circuit means includes logical AND circuitry.

10. The system of claim 9 wherein the spacing between the edges of said spaced electrodes is less than ten percent of the width of said spaced electrodes, the edges of said spaced electrodes are parallel to one another and spaced apart less than 0.1 millimeter.

11. The system of claim 10 and further including focusing means for focusing infrared radiation from multiple fields of view on corresponding ones of said infrared radiation sensitive elements.

12. The system of claim 11 wherein each said amplifier channel includes a field effect transistor, an absolute value detector circuit and a pulse stretcher circuit, and said coincidence circuit means includes logical AND circuitry.

13. The system of claim 12 wherein said pyroelectric material is selected from the class of lithium tantalate, lead zirconate titanate, lead germanate, strontium barium niobate, and polyvinylidene fluoride.

14. An intrusion detection system comprising a member of pyroelectric material, a plurality of infrared radiation sensitive elements of similar width, each said element comprising first and second spaced electrodes between which a polarized portion of said member of pyroelectric material is positioned, each said element being operative to product a voltage proportional to the rate of change of infrared radiation incident thereon, focusing means for focusing infrared radiation from multiple fields of view on corresponding ones of said infrared radiation sensitive elements, the spacing between the edges of said spaced electrodes being less than ten percent of the average width of said electrodes, the edges of said spaced electrodes being parallel to one another and spaced apart less than 0.1 millimeter so that the fields of view under surveillance are essentially fully covered, first and second amplifier channels, means connected one group of said polarized elements to said first amplifier channel, means connecting another similar group of said polarized elements to said second amplifier channel, and coincidence means for producing an alarm output in response to concurrent intruder signal generation by both of said channels.

15. The system of claim 14 wherein said member of pyroelectric material is polarized uniformly in one direction, one-half of said elements are connected to said first amplifier channel and the other half of said elements are connected to said second amplifier channel.

16. An intrusion detection system comprising a plurality of infrared radiation sensitive elements of similar width, each said element comprising first and second spaced electrodes between which polarized pyroelectric material is positioned so that adjacent pairs of said elements are oppositely polarized, each said element being operative to product a voltage proportional to the rate of change of infrared radiation incident thereon, focusing means of focusing infrared radiation from multiple fields of view on corresponding ones of said infrared radiation sensitive elements, the spacing between the edges of said spaced electrodes being less than ten percent of the average width of said electrodes, the edges of said spaced electrodes being parallel to one another and spaced apart less than 0.1 millimeter so that the fields of view under surveillance are essentially fully covered, first and second amplifier channels, means connecting one group of alterante ones of said polarized elements in parallel to said first amplifier channel, means connecting another similar group of alternate ones of said polarized elements in parallel to said second amplifier channel, and coincidence means for producing an alarm output in response to concurrent intruder signal generation by both of said channels.

17. An intrusion detection system comprising a plurality of infrared radiation sensitive elements of similar width, each said element comprising first and second spaced electrodes between which polarized pyroelectric material is positioned, each said element being operative to produce a voltage proportional to the rate of change of infared radiation incident thereon, focusing means for focusing infrared radiation from multiple fields of view on corresponding ones of said infrared radiation sensitive elements, the spacing between the edges of said spaced electrodes being less than ten percent of the average width of said electrodes, the edges of said spaced electrodes being parallel to one another and spaced apart less than 0.1 millimeter so that the fields of view under surveillance are essentially fully covered, first and second amplifier channels, means of connecting one group of alternate ones of said polarized elements to said first amplifier channel, means connecting the others of said polarized elements to said second amplifier channel, and coincidence means for producing an alarm output in response to concurrent intruder signal generation by both of said channels.

18. The system of claim 17 wherein each said amplifier channel includes a field effect transistor, an absolute value detector circuit and a pulse stretcher circuit, and said coincidence circuit means includes logical AND circuitry.

19. The system of claim 18 wherein said pyroelectric material is selected from the class of lithium tantalate, lead zirconate titanate, lead germanate, strontium barium niobate, and polyvinylidene fluoride.

20. The system of claim 19 wherein said pyroelectric material has parallel opposed surfaces, and said electrode areas cover substantially all of at least one of said surfaces.

* * * * *